US008961014B2

(12) United States Patent
Karim et al.

(10) Patent No.: US 8,961,014 B2
(45) Date of Patent: Feb. 24, 2015

(54) COMPRESSIBLE POUCH WITH MULTIPLE COLLAPSIBLE CHANNELS ACROSS BOTTOM

(75) Inventors: Rod M. Karim, San Diego, CA (US); Antonio Peralta, San Diego, CA (US); Miguel L. Aguilar, Escondido, CA (US)

(73) Assignee: S.C. Johnson & Son, Inc., Racine, WI (US)

( * ) Notice: Subject to any disclaimer, the term of this patent is extended or adjusted under 35 U.S.C. 154(b) by 129 days.

(21) Appl. No.: 13/384,254

(22) PCT Filed: Oct. 21, 2011

(86) PCT No.: PCT/US2011/057389

§ 371 (c)(1), (2), (4) Date: Jan. 16, 2012

(87) PCT Pub. No.: WO2012/054897

PCT Pub. Date: Apr. 26, 2012

(65) Prior Publication Data

US 2013/0101236 A1 Apr. 25, 2013

Related U.S. Application Data

(60) Provisional application No. 61/405,960, filed on Oct. 22, 2010.

(51) Int. Cl.
*B65D 30/00* (2006.01)
*B65D 33/01* (2006.01)
(Continued)

(52) U.S. Cl.
CPC ..... *B65D 31/14* (2013.01); *B65D 33/2591* (2013.01); *B65D 77/225* (2013.01)
USPC ..... 383/37; 383/100

(58) Field of Classification Search
CPC .... B65D 33/01; B65D 81/2023; B65D 85/18; B65D 33/2508
USPC ..... 383/100, 101, 103, 107, 37
See application file for complete search history.

(56) References Cited

U.S. PATENT DOCUMENTS 3,033,257 A * 5/1962 Weber ..... 383/103
3,133,691 A * 5/1964 Corbett ..... 383/103
(Continued)

FOREIGN PATENT DOCUMENTS

JP 10017012 A * 1/1998 ..... B65D 65/26
JP 10024968 A * 1/1998 ..... B65D 81/26
(Continued)

OTHER PUBLICATIONS

Abstract of KR100853473 (B1).
(Continued)

*Primary Examiner* — Jes F Pascua

(57) ABSTRACT

Compressible reclosable storage containers (e.g., pouches) having a one-way valve disposed along the bottom of the container. In one configuration, the reclosable pouch comprises a receptacle having a storage chamber and a mouth in communication with the storage chamber, and an airtight closure for closing the mouth. The receptacle comprises two walls made of thermoplastic web material, two side seals that include respective marginal portions of the two walls, and a vent that extends from one side seal to the other. The vent comprises a multiplicity of collapsible channels, each channel comprising a respective air inlet in flow communication with the storage chamber and a respective air outlet in flow communication with space external to the pouch. The channels may be formed by a series of zigzag or wave-shaped heat seals or heat seals have other shapes.

11 Claims, 9 Drawing Sheets

(51) Int. Cl.

| | |
|---|---|
| ***B65D 30/24*** | (2006.01) |
| ***B65D 33/25*** | (2006.01) |
| ***B65D 77/22*** | (2006.01) |

(56) References Cited

U.S. PATENT DOCUMENTS

| | | | | |
|---|---|---|---|---|
| 5,701,996 | A * | 12/1997 | Goto et al. | 206/287 |
| 5,922,162 | A * | 7/1999 | Brugger et al. | 156/275.1 |
| 5,973,768 | A * | 10/1999 | Mazion et al. | 355/72 |
| 6,357,915 | B2 | 3/2002 | Anderson | |
| 6,729,473 | B2 | 5/2004 | Anderson | |
| 6,814,491 | B1 * | 11/2004 | Tang | 383/100 |
| 6,945,695 | B2 * | 9/2005 | Rabiea | 383/37 |
| 7,448,803 | B2 * | 11/2008 | Ootsubo | 383/100 |
| 7,708,464 | B2 * | 5/2010 | Tanaka | 383/100 |
| 2002/0090151 | A1 * | 7/2002 | Skeens et al. | 383/100 |
| 2004/0057636 | A1 * | 3/2004 | Ishizaki | 383/44 |
| 2004/0234171 | A1 | 11/2004 | Dais et al. | |
| 2006/0120631 | A1 | 6/2006 | Tang | |
| 2009/0097781 | A1 | 4/2009 | Tang | |
| 2009/0190863 | A1 | 7/2009 | Calvo et al. | |
| 2009/0238497 | A1 * | 9/2009 | Liao et al. | 383/103 |
| 2010/0021092 | A1 | 1/2010 | Ootsubo et al. | |

FOREIGN PATENT DOCUMENTS

| | | | | |
|---|---|---|---|---|
| JP | 2000219252 | A * | 8/2000 | B65D 33/25 |
| JP | 2003020046 | A * | 1/2003 | B65D 30/10 |
| JP | 2003335349 | A * | 11/2003 | B65D 33/01 |
| JP | 2004010101 | A * | 1/2004 | B65D 33/01 |
| KR | 10-0853473 | B1 | 8/2008 | |
| WO | WO 2009090674 | A2 * | 7/2009 | B65D 33/01 |

OTHER PUBLICATIONS

Search Report for WO 2012/054897 A3, May 11, 2012.

* cited by examiner

COMPRESSIBLE POUCH WITH MULTIPLE COLLAPSIBLE CHANNELS ACROSS BOTTOM

RELATED PATENT APPLICATION

This application claims foreign priority benefits under 35 U.S.C. §365(a) of PCT International Patent Application No. PCT/US2011/057389 filed on Oct. 21, 2011, which PCT international application in turn claims priority to U.S. Provisional Application Ser. No. 61/405,960 filed on Oct. 22, 2010.

BACKGROUND

This disclosure generally relates to reclosable flexible storage containers (e.g., pouches) whose interior volume is hermetically sealed (i.e., airtight) when the container is closed. In particular, this disclosure relates to airtight reclosable storage containers that can be collapsed by removal of air from the interior.

Collapsible reclosable storage containers typically include a flexible, airtight pouch, an opening through which an article is inserted inside the pouch, a zipper for closing the opening and hermetically sealing the pouch, and a one-way valve through which excess air is removed from the pouch. A user places an article into the pouch through the opening, seals the opening, and then removes air from the pouch via the one-way valve. During air removal, a compressible article contained therein may be significantly compressed so that it is easier to transport and requires substantially less storage space.

For one category of compressible reclosable storage pouches, air is removed from the interior volume via one or more one-way valves, each one-way valve being a channel or vent that allows air to escape when the contents of the pouch are compressed, but prevents the return of ambient air into the pouch when the pressure is released. Typically the contents are compressed and air inside the pouch is forced out when the user presses down on or rolls the pouch and its contents. The volume of the entire contents can be greatly reduced by forcing the air out of the pouch through the one-way valves. However, if a one-way valve channel is disposed adjacent and parallel to a bottom seal, it is possible that a user could accidentally place his hands over the channel. In that situation, when the user presses down on the pouch, the pressure on the channel would make it more difficult to expel air through the now-blocked channel. In some known compressible pouches, it is difficult for a user to start the air egress from the pouch due to the small number of channels available for the air to exit. If the number of air egress channels or vents is small, these channels can be easily blocked by the items inside the pouch.

There is a need for an improved construction for compressible storage containers that overcomes the foregoing disadvantages.

SUMMARY

This disclosure is directed to airtight compressible storage containers (e.g., pouches) having a one-way valve disposed along the bottom of the container. In various embodiments, the one-way valve comprises a multiplicity of collapsible channels. Each channel comprises a respective air inlet in flow communication with a storage chamber inside the container and a respective air outlet in flow communication with space external to the container. The channels may be formed by a series of zigzag or wave-shaped heat seals or heat seals have other shapes.

When the contents of the pouch are compressed by a user pushing down on or rolling the pouch, air from the storage chamber containing the compressible contents is forced through some or all of the air inlets and into the associated channels, thereby forcing the collapsed channels open. When the channels have been fully opened, continued pushing down on or rolling the pouch causes the air that was forced into the channels to escape via the associated air outlets. This procedure can be continued until the desired amount of air has been removed from the pouch. When the pressure exerted on the pouch by the user is removed, the channels collapse, thereby blocking the re-entry of ambient air into the pouch. Because the collapsible channels are disposed across the entire width of the pouch, the risk that the user will accidentally obstruct the escape of air out of the pouch is reduced.

In view of the foregoing, one aspect of the invention is a reclosable pouch comprising: a receptacle having a storage chamber and a mouth in communication with the storage chamber, and an airtight closure for closing the mouth, wherein the receptacle comprises first and second walls made of thermoplastic web material, a first side seal that includes respective first marginal portions of the first and second walls, a second side seal that includes respective second marginal portions of the first and second walls, and a vent that extends from the first side seal to the second side seal, the vent comprising a multiplicity of collapsible channels, each channel having a respective air inlet in flow communication with the storage chamber and a respective air outlet in flow communication with space external to the pouch.

Another aspect of the invention is a reclosable pouch comprising: a receptacle having a storage chamber and a mouth in communication with the storage chamber, and an airtight closure for closing the mouth, wherein the receptacle comprises first and second walls made of thermoplastic web material, a first side seal that includes respective first marginal portions of the first and second walls, a second side seal that includes respective second marginal portions of the first and second walls, and a multiplicity of seals arranged within an area that extends from the first side seal to the second side seal and parallel to bottom edges of the first and second walls, wherein adjacent seals of the multiplicity of seals are spaced apart to form a multiplicity of collapsible channels, each of the channels comprising a respective air inlet in flow communication with the storage chamber and a respective air outlet in flow communication with space external to the pouch and being bounded at least in part by respective unsealed portions of the first and second walls.

A further aspect of the invention is a roll comprising a chain of reclosable pouch precursors connected by a multiplicity of transverse seals spaced at equal intervals along a lengthwise direction, each pouch precursor comprising a respective receptacle having a storage chamber and a mouth in communication with the storage chamber, and an airtight closure for closing the mouth, the storage chambers being disposed between respective pairs of the transverse seals, wherein each receptacle comprises respective confronting sections of first and second webs of thermoplastic material and a vent that extends between a respective pair of transverse seals, the vent of each pouch precursor comprising a multiplicity of collapsible channels, each channel having a respective air inlet in flow communication with the storage chamber and a respective air outlet in flow communication with space external to the pouch precursor.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION

Figure 1:
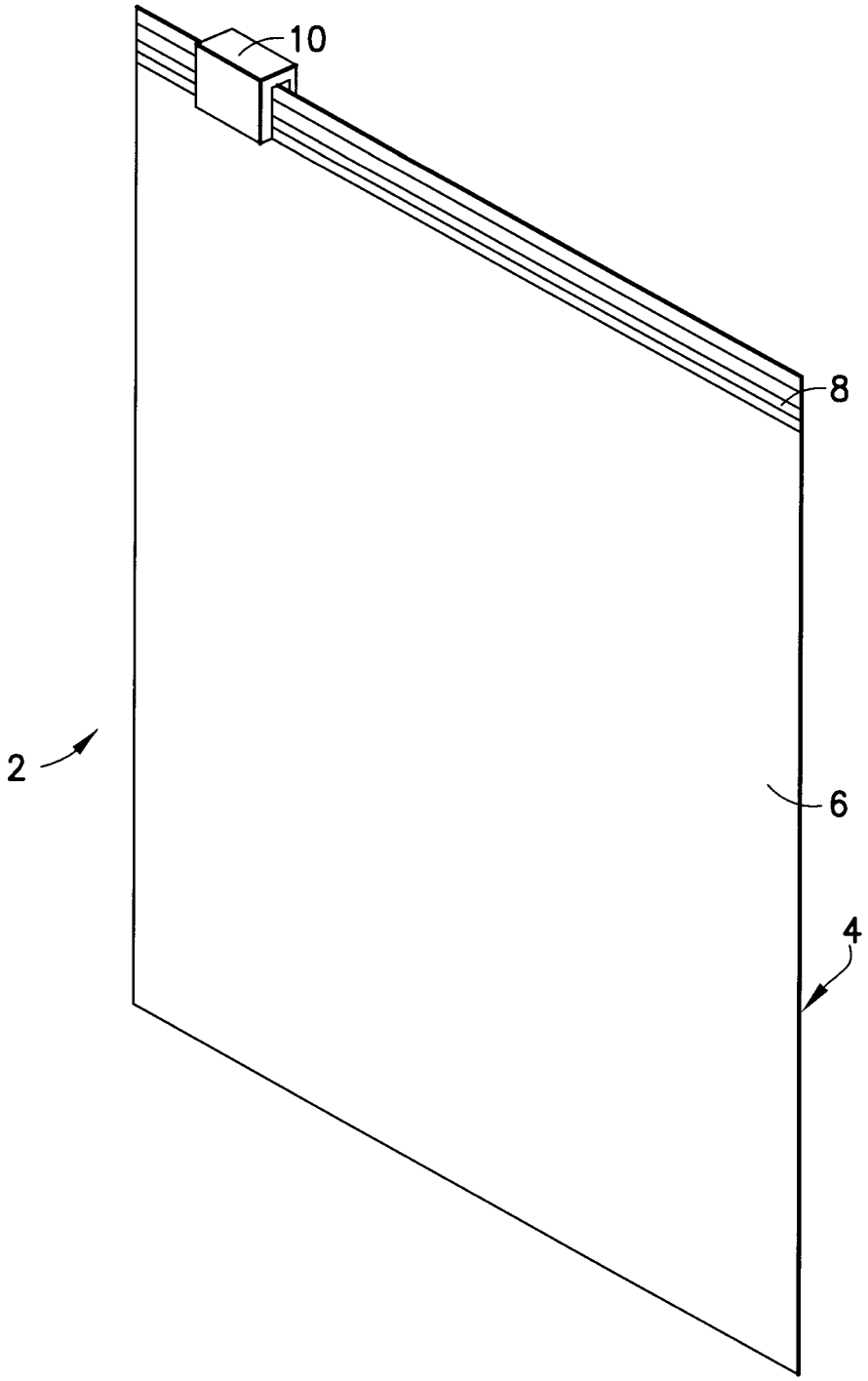
FIG. 1 is a diagram showing an isometric view of a collapsible reclosable storage pouch.

FIG. 1 shows a collapsible reclosable storage pouch 2 in accordance with one embodiment. The storage pouch 2 comprises a receptacle 4 consisting of a front wall or panel 6 and a rear wall or panel (not shown), which are sealed together along their side edges. The upper marginal portions of the front and rear walls form a mouth in which a plastic zipper 8 is installed. Although not shown in FIG. 1, the receptacle 4 incorporates bottom channels that allow escape of air from the interior volume when the contents (not shown) of the receptacle are compressed, but prevent the entry of air into the receptacle when the external pressure is released.

During use, one or more discrete compressible articles (not shown) may be placed inside the receptacle 4 while the zipper 8 is open, i.e., while the closure profiles of the interlockable zipper strips are disengaged from each other. After the article to be stored has been placed inside the receptacle, the mouth of the receptacle 4 can be sealed by pressing the zipper strips together to cause their respective closure profiles to interlock. Although the zipper closure profiles may have many different designs, the design must be one that ensures formation of an airtight seal at the receptacle mouth.

Still referring to FIG. 1, the zipper strips can be pressed together using a device 10 commonly referred to as a "slider" or "clip", which straddles the zipper. The typical slider has a generally U-shaped profile, with respective legs disposed on opposing sides of the zipper. The gap between the slider legs is small enough that the zipper can pass through the slider gap only if the zipper is in a closed state. Thus when the slider is moved along an open zipper, this has the effect of pressing the incoming sections of the zipper strips together. A suitable slider is disclosed in U.S. Pat. No. 7,490,989. The zipper is opened by pulling apart the zipper upper flanges, as explained in more detail below. The slider can be molded from any suitable plastic.

The front and rear wall panels of the receptacle 4 are respectively sealed to the zipper by lengthwise conduction heat sealing in conventional manner. Alternatively, the zipper can be attached to the wall panels by adhesive or bonding strips or the zipper can be extruded integrally with the web material. The walls of the receptacle may be formed of various types of gas-impermeable thermoplastic web material. The preferred gas-impermeable thermoplastics are nylon, polyester, polyvinyl dichloride and ethylene vinyl alcohol. The web material may be either transparent or opaque.

To maintain a vacuum inside the storage pouch, the zipper in a closed state must provide a hermetic seal at the mouth (i.e., fourth side) of the pouch. The present invention is not directed to any particular zipper construction. For the sake of illustration, however, a suitable zipper for use with the present invention will now be described with reference to FIG. 2.

Figure 2:
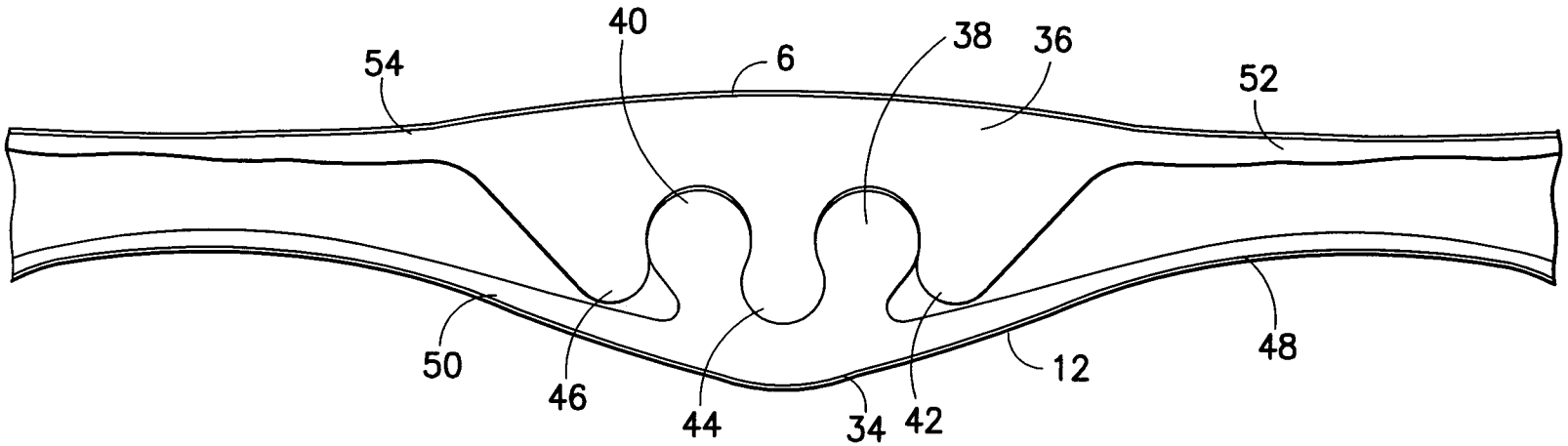
FIG.2 PRIOR ART
FIG. 2 is a diagram showing a cross-sectional view of a known zipper suitable for use with a pouch of the type depicted in FIG. 1.

FIG. 2 shows a known zipper 8 that comprises a pair of mutually interlockable extruded zipper strips 34 and 36. The zipper strip 34 comprises a pair of projections 38 and 40 having ball-shaped closure profiles, an upper flange 48, and a lower flange 50. The zipper strip 36 comprises three projections 42, 44 and 46 (projection 44 has a ball-shaped closure profile), an upper flange 52, and a lower flange 54. For each zipper strip, the portions exclusive of the projections will be referred to herein as a "base". The front wall 6 and rear wall 12 of the receptacle may be joined to the respective bases of the zipper strips by conduction heat sealing across their entire height or across only portions thereof. For example, the pouch walls could be joined to the zipper lower flanges and to the upper flanges by means of conduction heat sealing.

Still referring to FIG. 2, the projections 38 and 40 interlock with projections 42, 44 and 46 by fitting inside the respective spaces therebetween. The upper flanges 48 and 52 can be gripped by the user and pulled apart to open the closed zipper. The opened zipper can be reclosed by pressing the zipper strips together (e.g., using a slider) along the entire length of the zipper with sufficient force to cause the projections 38 and 40 to enter the respective spaces between the projections 42, 44 and 46. Typically, such a slider takes the form of a U-shaped clip that fits over the zipper with clearance for the upper flanges, while the legs of the clip cam the zipper profiles of the incoming zipper section into engagement when the slider is moved along the zipper in either direction. Typically, the ends of the zipper strips 34 and 36 are joined together at the sides of the pouch. The ends of the zipper strips may be fused together at the same time that the container side seals are formed. The side seals are typically formed by applying heat and pressure in amounts sufficient to fuse and flatten the closure profiles at the ends of the zipper, which process is often called "thermal crushing".

Figure 3:
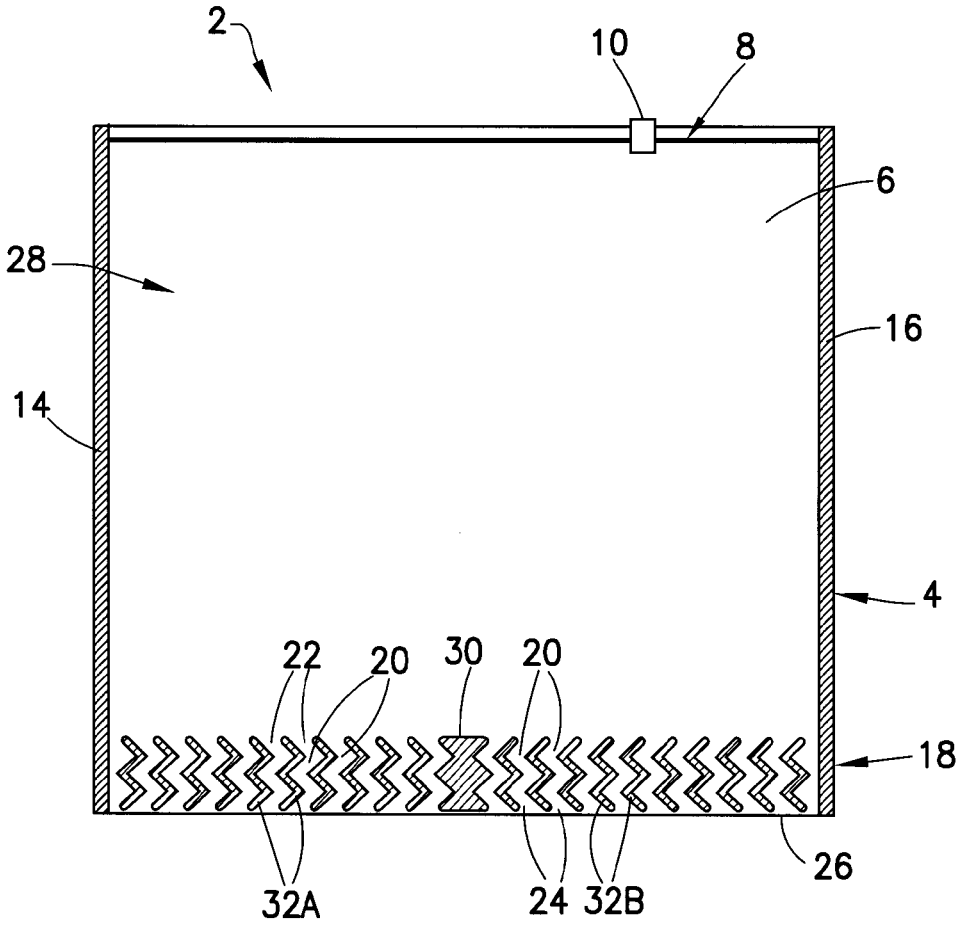
FIG. 3 is a diagram showing a plan view of an airtight compressible reclosable storage pouch having a one-way valve arranged across its bottom in accordance with one embodiment. The hatching indicates heat seals.

An empty collapsible reclosable storage pouch having a one-way valve arranged across a bottom thereof in accordance with one embodiment is shown in FIG. 3, in which heat-sealed regions are indicated by hatching. For ease of description, the empty pouch is shown in a planar state. The reclosable pouch comprises a receptacle having a storage chamber 28 and a mouth in communication with the storage chamber, and an airtight zipper 8 for closing the mouth. Other types of airtight closures can be used instead of a zipper, e.g., opposing strip-shaped layers of low-tack adhesive or cohesive material. The receptacle comprises a front wall 6 and a rear wall (not shown in FIG. 3), both walls being rectangular panels made of thermoplastic web material (e.g., thermoplastic film). A first side seal 14 includes respective first marginal areas that extend along left-hand side edges of the front and rear walls, while a second side seal 16 includes respective second marginal areas that extend along right-hand side edges of the front and rear walls.

In accordance with one embodiment, the pouch 2 is provided with a one-way valve in the form of a row 18 of respective collapsible zigzag channels 20 which are arranged side by side across the bottom of the pouch in the region between the side seals 14 and 16. Each zigzag channel has a W shape that is rounded at each vertex. Because the pouch is empty and in a planar state, the zigzag channels 20 shown in FIG. 3 are in a collapsed, i.e., closed, state. Each collapsible zigzag channel 20, when open, communicates with a respective air inlet 22 located in the interior volume of the pouch and a respective air outlet located at the bottom edge 26 of the pouch. When the contents of the pouch are compressed by a user pushing down on the pouch, air from the storage chamber 28 containing the compressible contents (not shown in the drawings) is forced through the air inlets 22 and into some or all of the channels 20, thereby forcing some or all of the collapsed channels open. When those channels 20 have been fully opened, continued pushing down on the pouch causes the air that was forced into those channels to escape via respective air outlet 24. This procedure can be continued until the desired amount of air has been removed from the pouch. When the pressure exerted on the pouch by the user is removed, the opened channels collapse, thereby blocking the re-entry of ambient air into the pouch via those channels. Because the collapsible channels are arranged across the entire bottom portion of the pouch, the risk that the user will accidentally obstruct the flow of air through all of the channels at once is very low. Therefore, even if some of the channels are blocked due to pressure exerted by the user, the air inside the pouch can escape via other channels that are not blocked.

Figure 6:
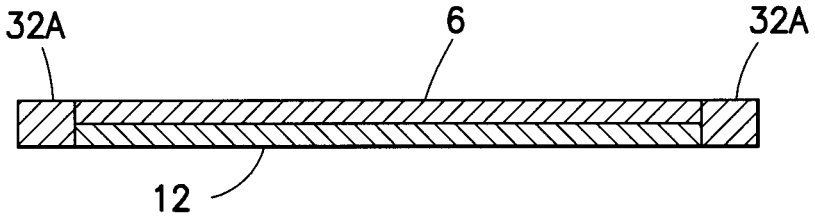
FIG. 6 is a diagram showing a cross-sectional view of a single collapsible channel (of the type depicted in FIG. 3) in a collapsed state.

The zigzag channels 20 are disposed between and defined by a multiplicity of regions where the thermoplastic materials of the front and rear walls are heat sealed together to form a chevron-like pattern. In the particular embodiment depicted in FIG. 3, the multiplicity of heat seals include a central heat seal 30 in the shape of a 10-sided polygon with opposing zigzag edges, a first set of zigzag heat seals 32A arrayed across an area extending between central heat seal 30 and side heat seal 14, and a second set of zigzag heat seals 32B arrayed across an area extending between central heat seal 30 and side heat seal 16. The side edges of central heat seal 30 respectively conform to the shape of the side edges of adjacent zigzag heat seals 32A and 32B, so that zigzag channels are formed on both sides of the central heat seal 30. Likewise, respective zigzag channels are formed between pairs of adjacent zigzag edges of heat seal 30, 32A and 32B. As seen in FIG. 3, the zigzag heat seals 32A on one side of the pouch bottom are oriented such that their ends and a center vertex are closer to heat seal 14 than the other vertices are; the zigzag heat seals 32B on the other side of the pouch bottom are arranged to be mirror images of heat seals 32A. The heat seals 32A and 32B are spaced in a manner such that, in the absence of air pressure at the inlets 22, the channels 20 will remain closed (as seen in FIG. 6).

In the embodiment shown in FIG. 3, each heat seal in sets 32A and 32B consists of four legs that form a W shape. However, the scope of the invention is broad enough to encompass the use of zigzag heat seals having a different number of legs. Also other patterns can be employed. For example, the heat seals could be serpentine, resulting in serpentine channels, or some shape that combines alternating curved and straight segments.

Figure 4:
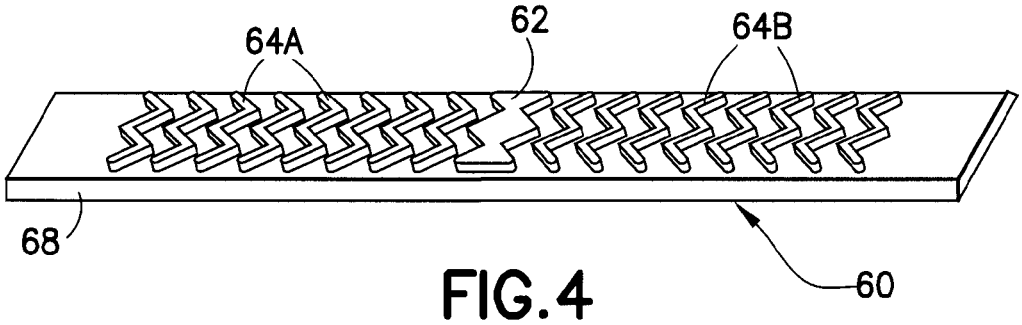
FIG. 4 is a diagram showing an isometric view of a sealing bar for forming the valve depicted in FIG. 3.
Figure 5:
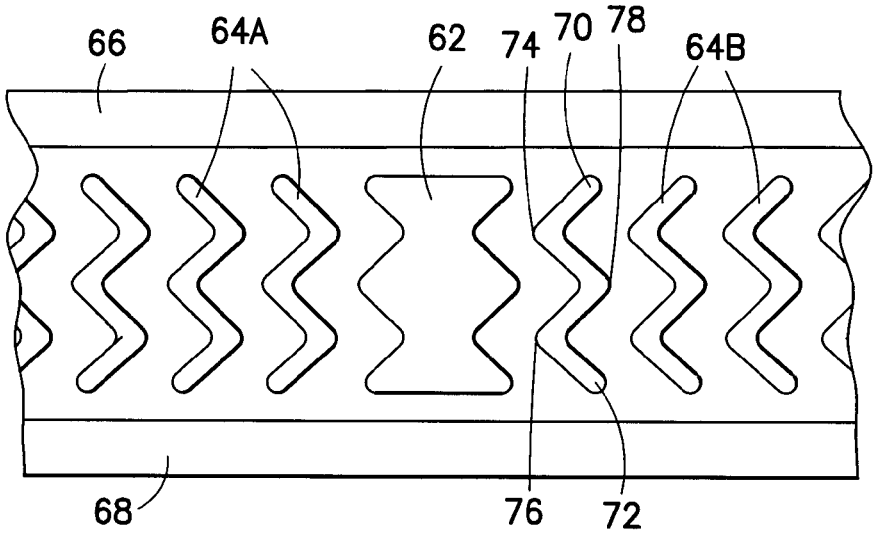
FIG. 5 is a diagram showing a plan view of a central portion of the sealing bar depicted in FIG. 4.

The heat seals can be formed by conductive heat sealing in a well-known manner using a heated sealing bar having forms of a desired shape, for example, a W shape with rounded vertices or serpentine or some shape that combines alternating curved and straight segments. The geometry of such a sealing bar 60, having a center form 62 and left and right sets of zigzag forms 64A and 64B, is shown in FIG. 4. The sealing bar 60 can be made of aluminum or any other suitable material and has beveled longitudinal sides 66 and 68. The sealing bar 60 is heated and then pressed against the two layers of bag film to form the seal pattern depicted in FIG. 3. The backing which supports the bag film during the formation of the zigzag seals can be made of silicone rubber or any other suitable material. The shape of the zigzag forms 64A and 64B is shown in more detail ion FIG. 5. As seen in FIG. 5, the ends 70 and 72 of each zigzag form are round, as are the vertices 74, 76 and 78.

During use of the pouch depicted in FIG. 3, the zipper 8 is opened and then the storage chamber 28 is loaded with compressible contents. The zipper 8 is then closed, thereby hermetically sealing the mouth of the receptacle. If the user then places the loaded pouch on a support surface and pushes down on the loaded pouch, thereby compressing the compressible contents, air will be forced out of the pouch via the zigzag channels 20. When the user pushes down on the loaded pouch, the air pressure causes the collapsible channels to open. When the external pressure is released, those channels collapse, thereby preventing the entry of ambient air into the receptacle.

Figure 7:
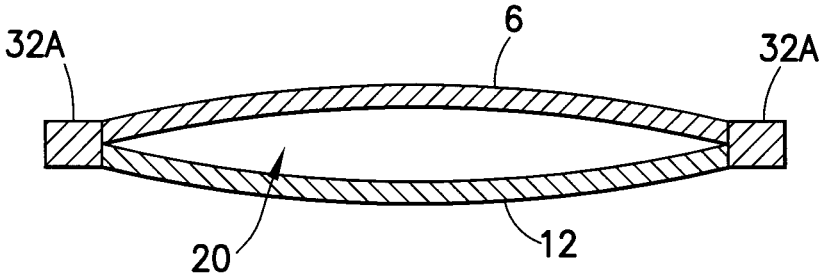
FIG. 7 is a drawing showing a cross-sectional view, similar to FIG. 6, but showing the opened (i.e., not collapsed) state of the collapsible channel as air is being pushed out of the pouch.

FIG. 6 shows a cross section of a collapsed channel 20 bounded on opposite sides by respective zigzag heat seals 32A. The one-way valve comprises a portion of front wall 6 and an opposing portion of rear wall 12. Portions of the front and rear walls are joined at the heat seals 32A. FIG. 7 shows the channel cross section when the channel is open (i.e., not collapsed), for example, in response to air being forced out of the pouch by application of external pressure. As a result, the air flows between confronting portions of the front and rear walls. When air is not being forced out of the pouch, ambient atmospheric pressure is sufficient to press the front and rear wall portions together to re-close the channel (as seen in FIG. 6), thereby stopping unwanted air from entering the storage chamber 28 and preserving the compressed state of the pouch contents.

The pouch described above can be manufactured on an automated production line. For example, two webs of thermoplastic material, having the same width, can be paid out from respective rolls and placed in overlying relationship. At the same time, a zipper tape is paid out from a reel and disposed between marginal portions of the first and second webs. Then the zipper tape is joined to both webs, for example, by conductive heat sealing. The opposing marginal portions of the webs (which will become the bottom of the pouches) are heat sealed to form the zigzag channels described above, for example, using a heated sealing bar that has a raised chevron pattern formed on its face. Then transverse heat seals are formed across the two webs, which seals will become the pouch side seals after being bisected during a cutting operation. Between each transverse heat sealing operation, the webs are advanced by a distance equal to one pouch width. In addition, the manufacturing process may include thermal crushing of the zipper profile in the area of the transverse side seals.

Figure 8:
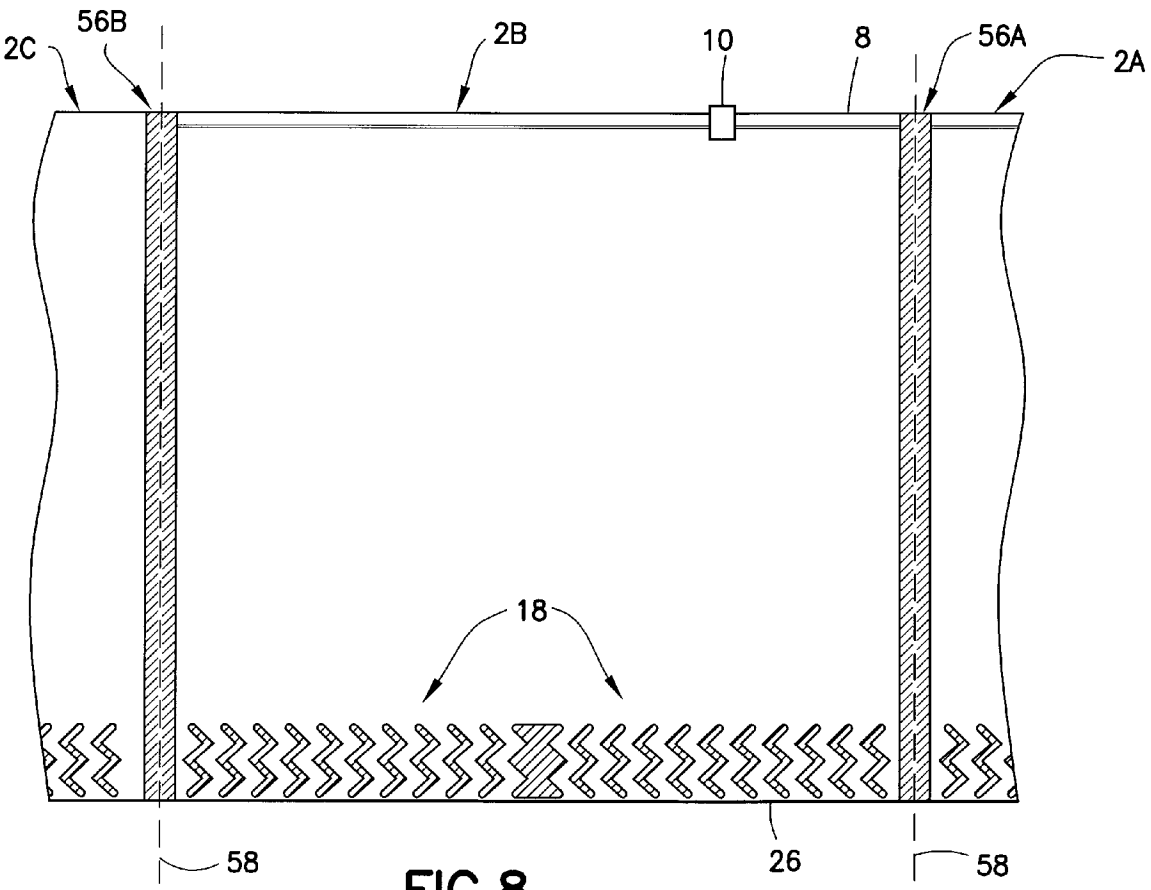
FIG. 8 is a drawing showing a plan view of a chain of pouch precursors at a process stage subsequent to heat sealing and prior to cutting the chain along transverse lines (indicated by dashed lines) that bisect the transverse heat seals to separate pouches from the chain.

Bearing in mind the process described in the preceding paragraph, FIG. 8 shows a distal portion of a chain of pouch precursors in process at a point upstream of the cutting station. Leading and lagging transverse seals resulting from successive operations at the transverse heat sealing station are indicated by respective hatched areas 56A and 56B. Each completed pouch 2A, 2B and 2C can be severed from the work in process by cutting along cut lines (indicated by dashed lines 58A and 58B in FIG. 8) which bisect the respective transverse heat seals. The transverse seal 56A, when bisected, becomes the left side seal of pouch 2A and the right side seal of pouch 2B; the transverse seal 56B, when bisected, becomes the left side seal of pouch 2B and the right side seal of pouch 2C.

Alternatively, the chain of pouch precursors could be wound on a roll (i.e., without cutting) for transport to a cutting station. Thus, it is within the scope of this invention to not sever each completed pouch at the leading end of the chain of pouch precursors and instead to wind the chain of pouch precursors on a roll for transport to another location. At such other location, the connected pouch precursors can be unwound from the roll and severed to form individual pouches.

Figure 9:
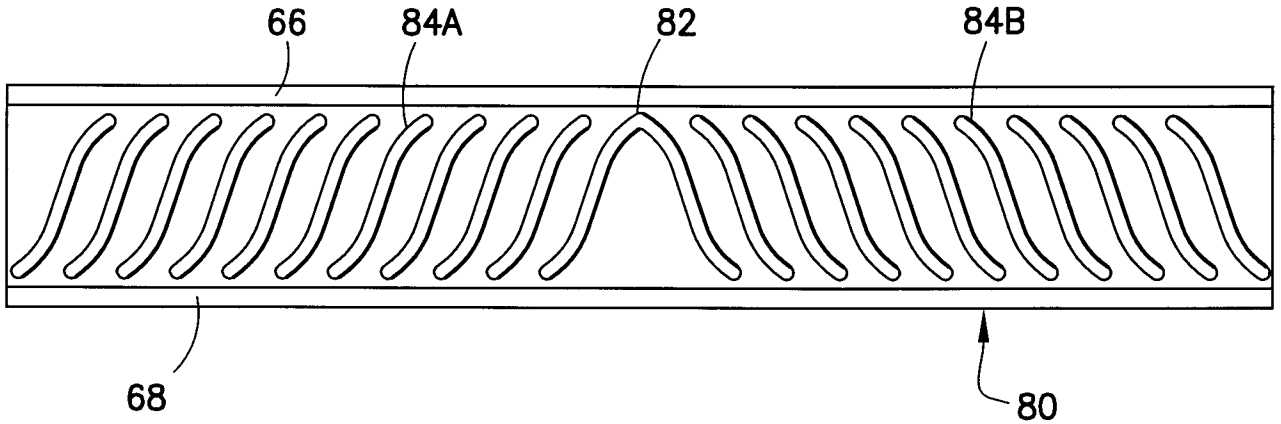
FIG. 9 is a diagram showing a plan view of a sealing bar for forming a one-way valve comprising wave-shaped channels on a compressible pouch in accordance with an alternative embodiment.

In accordance with an alternative embodiment, each heat seal could consist of two oppositely curved sections connected to each other or connected by a straight section. A sealing bar 80 for forming heat seals consisting of two oppositely curved sections connected to a straight section is shown in FIG. 9. The sealing bar 80 has a center form 82 and left and right sets of wave-shaped forms 84A and 84B. The center form 82 consists of two wave-shaped segments which are connected at one end, the left-hand wave-shaped segment of center form 82 having the same size, shape and orientation as the wave-shaped forms 84A and the right-hand wave-shaped segment of center form 82 having the same size, shape and orientation as the wave-shaped forms 84B. In accordance with one implementation, each wave-shaped form 84A and 84B may consist of a first arc-shaped section that curves in a first direction, a second arc-shaped section that curves in the opposite direction and a straight section that connects the two arc-shaped sections. The sealing bar 80 can be made of aluminum or any other suitable material and has beveled longitudinal sides 66 and 68. The sealing bar 80 can be heated and then pressed against the two layers of bag film to form a row of wave-shaped channels, the channels on the left side being a mirror image of the channels on the right side. The arc-shaped portions of wave-shaped forms 84A and 84B form the inlets and outlets and curved portions of the collapsible channels, while the straight portions of forms 84A and 84B form straight central portions of those channels.

Figure 10:
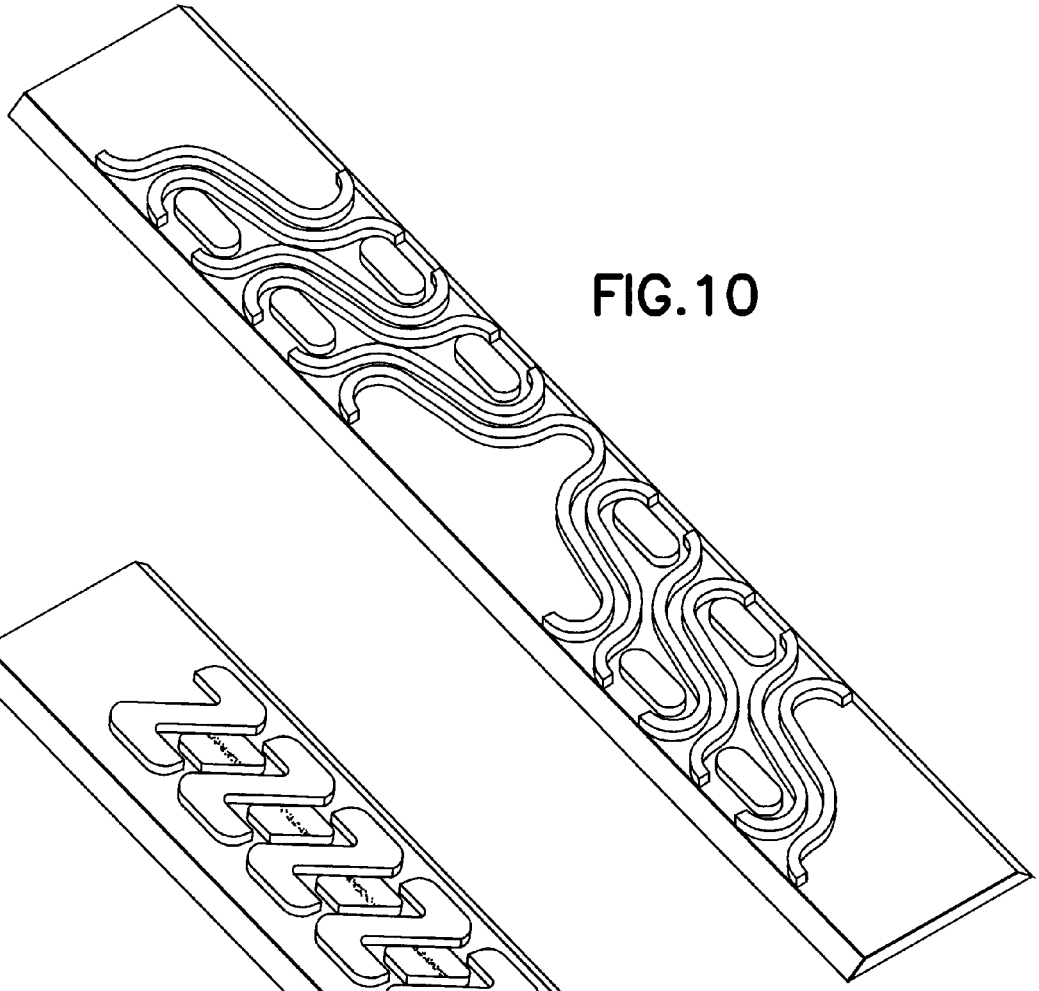
FIGS. 10 through 13 are diagrams showing respective isometric views of sealing bars having different geometries in accordance with further alternative embodiments.
Figure 11:
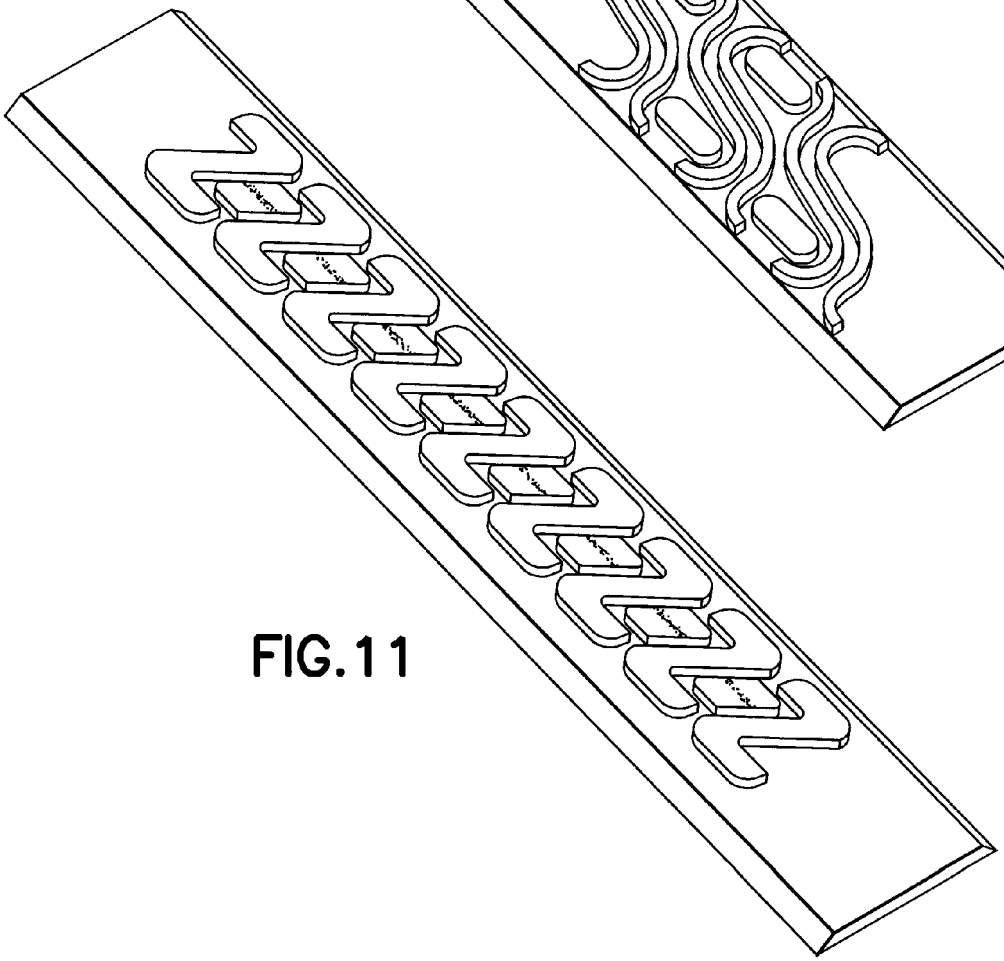
Figure 12:
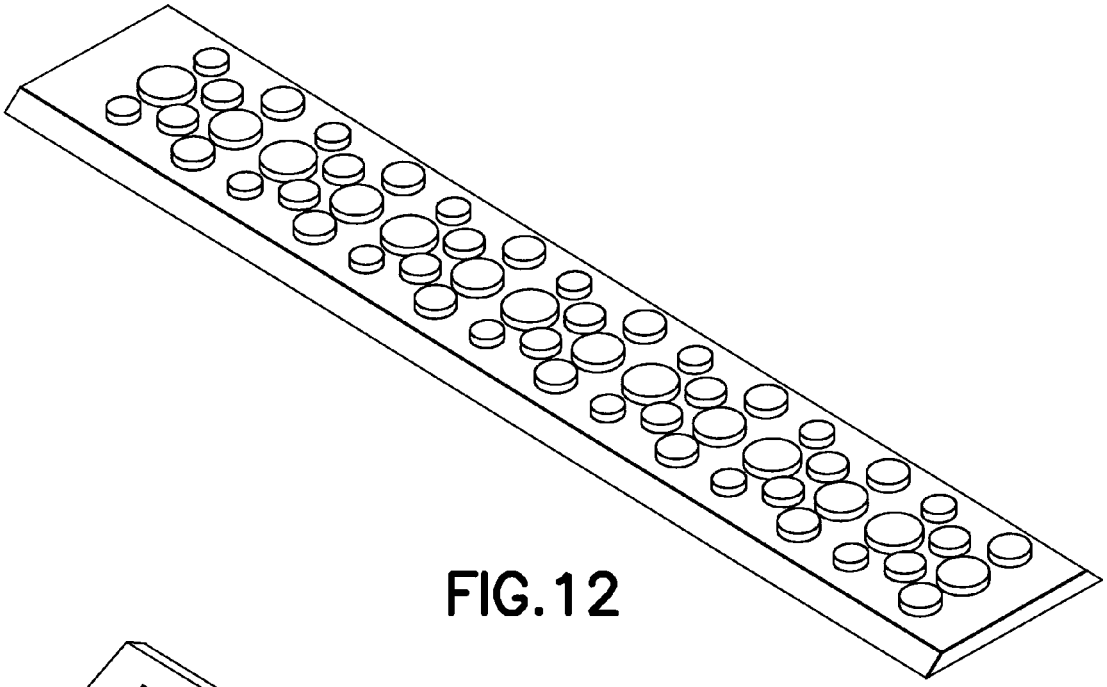
Figure 13:
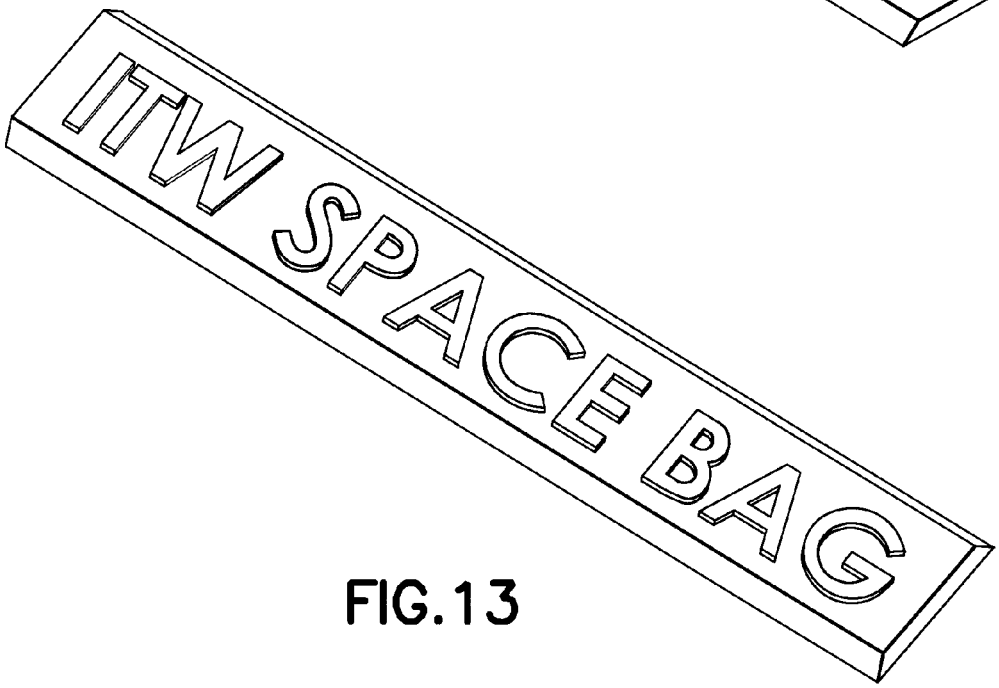

FIGS. 10 through 13 show respective sealing bars having different geometries in accordance with further alternative embodiments. FIG. 12 shows a sealing bar for producing circular heat seals, but other shapes, such as ovals and ellipses could also be used. Other exemplary sealing bars are shown in FIGS. 10, 11 and 13. Many other geometric patterns can be adopted provided that a multiplicity of channels are created along the pouch bottom.

In accordance with a further embodiment, two intervening layers of valve film material, each having a smoothness greater than the smoothness of the thermoplastic web material of the pouch walls, can be incorporated in the bottom area of the pouch. These layers of valve film material could be heat sealed to form the collapsible channels. Then the resulting channel array could be joined to the pouch walls. In forming the valve film layers, various materials may be employed. Such materials include, but are not limited to, low-density polyethylene (LDPE) or linear low-density polyethylene (LLDPE). A person of ordinary skill in the art will appreciate that instead of two valve film layers, a single valve film layer could be used. That single valve film layer would be joined to one of the pouch walls and then the chevron heat seal pattern would be formed by heat sealing the valve film layer to the opposite pouch wall. In known manner, the valve film material must be sealed to the respective pouch walls in the area of the channel air inlets to ensure that the exiting air passing through the channels and not through any unsealed space between a pouch wall and the adjacent strip of valve film material.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The invention claimed is:

1. A reclosable pouch comprising: a receptacle having a storage chamber and a mouth in communication with said storage chamber, and an airtight closure for closing said mouth, wherein said receptacle comprises first and second walls made of thermoplastic web material, a first side seal that includes respective first marginal portions of said first and second walls, a second side seal that includes respective second marginal portions of said first and second walls, said first and second side seals extending from a top edge to a bottom edge of said first wall, and a multiplicity of seals where confronting portions of said first and second walls are sealed together without any intervening layers of web material therebetween and which form a multiplicity of channels disposed across a bottom portion of said receptacle adjacent said bottom edge, each channel having a respective air inlet in flow communication with said storage chamber and a respective air outlet in flow communication with space external to said pouch and being partly defined by respective unsealed confronting portions of said first and second walls having no cuts therein, wherein said air outlets open adjacent said bottom edge, said multiplicity of seals comprise first through third seals having a zigzag shape or first through third seals having a wave shape, and said multiplicity of channels comprise first and second channels, said first channel being defined by said first and second seals and opposing respective first portions of said first and second walls, and said second channel being defined by said second and third seals and opposing respective second portions of said first and second walls, and wherein said first and second channels are configured to open when the mouth is closed and air is being expelled from said storage chamber but collapse when air is no longer being expelled from said storage chamber to block re-entry of ambient air into said storage chamber via said first and second channels.

2. The reclosable pouch as recited in claim 1, wherein said multiplicity of seals further comprise a fourth seal, and said multiplicity of collapsible channels further comprise a third channel bounded by said third and fourth seals.

3. The reclosable pouch as recited in claim 1, wherein said storage chamber extends to and is in direct flow communication with said air inlets across a full width of said storage chamber without any sealing together of the first and second walls between said storage chamber and said air inlets.

4. A reclosable pouch comprising: a receptacle having a storage chamber and a mouth in communication with said storage chamber, and an airtight closure for closing said mouth, wherein said receptacle comprises first and second walls made of thermoplastic web material, a first side seal that includes respective first marginal portions of said first and second walls, a second side seal that includes respective second marginal portions of said first and second walls, said first and second side seals extending from a top edge to a bottom edge of said first wall, and a multiplicity of seals where confronting portions of said first and second walls are sealed together without any intervening layers of web material therebetween, said seals being arranged within an area that extends from said first side seal to said second side seal and parallel to bottom edges of said first and second walls, wherein adjacent seals of said multiplicity of seals are spaced apart to form a multiplicity of channels, each of said channels comprising a respective air inlet in flow communication with said storage chamber without any sealing together of the first and second walls between said storage chamber and said air inlets and a respective air outlet in flow communication with space external to said pouch and being bounded at least in part by respective unsealed portions of said first and second walls, each channel being partly defined by respective unsealed confronting portions of said first and second walls having no cuts therein, wherein said air outlets open adjacent said bottom edge, said multiplicity of seals comprise first through third seals having a zigzag shape or first through third seals having a wave shape, and said multiplicity of channels comprise first and second channels, said first channel being bounded by said first and second seals, and said second channel being bounded by said third and fourth seals, and wherein said first and second channels are configured to open when the mouth is closed and air is being expelled from said storage chamber but collapse when air is no longer being expelled from said storage chamber to block re-entry of ambient air into said storage chamber via said first and second channels.

5. The reclosable pouch as recited in claim 4, wherein said multiplicity of seals further comprise a fourth seal, and said multiplicity of collapsible channels further comprise a third channel bounded by said third and fourth seals.

6. The reclosable pouch as recited in claim 4, wherein said storage chamber extends to and is in direct flow communication with said air inlets across a full width of said storage chamber without any sealing together of the first and second walls between said storage chamber and said air inlets.

7. A roll comprising a chain of reclosable pouch precursors connected by a multiplicity of transverse seals spaced at equals intervals along a lengthwise direction, each pouch precursor comprising a respective receptacle having a storage chamber and a mouth in communication with said storage chamber, and an airtight closure for closing said mouth, said storage chambers being disposed between respective pairs of said transverse seals, wherein each receptacle comprises respective confronting sections of first and second webs of thermoplastic material and a one-way vent that extends between a respective pair of transverse seals, said one-way vent of each pouch precursor comprising a multiplicity of seals where confronting portions of said first and second webs are sealed together without any intervening layers of web material therebetween and which form a multiplicity of channels disposed across a bottom portion of each receptacle adjacent a bottom edge, each channel having a respective air inlet in flow communication with said storage chamber and a respective air outlet in flow communication with space external to said pouch precursor, each channel being partly defined by respective unsealed confronting portions of said first and second walls having no cuts therein, wherein said air outlets of each receptacle open adjacent said bottom edge, said multiplicity of seals of each receptacle comprise first through third seals having a zigzag shape or first through third seals having a wave shape, and said multiplicity of channels of each receptacle comprise first and second channels, said first channel being bounded by said first and second seals, and said second channel being bounded by said second and third seals, and wherein said first and second channels are configured to open when air is being expelled from said storage chamber but collapse when air is no longer being expelled from said storage chamber to block re-entry of ambient air into said storage chamber via said first and second channels.

8. The roll as recited in claim 7, wherein said air outlets are adjacent to said bottom edges of said first and second webs.

9. The roll as recited in claim 7, wherein said first through third seals are formed by areas where respective opposing portions of said first and second walls are sealed together.

10. The reclosable pouch as recited in claim 7, wherein said multiplicity of seals further comprise a fourth seal, and said multiplicity of collapsible channels further comprise a third channel bounded by said third and fourth seals.

11. The roll as recited in claim 7, wherein said storage chamber extends to and is in direct flow communication with said air inlets across a full width of said storage chamber without any sealing together of the first and second walls between said storage chamber and said air inlets.

* * * * *